United States Patent [19]

Kalina

[11] Patent Number: 4,732,005

[45] Date of Patent: Mar. 22, 1988

[54] DIRECT FIRED POWER CYCLE

[76] Inventor: Alexander I. Kalina, 12214 Clear Fork, Houston, Tex. 77077

[21] Appl. No.: 15,102

[22] Filed: Feb. 17, 1987

[51] Int. Cl.[4] ..... F01K 25/06

[52] U.S. Cl. ..... 60/673; 60/649

[58] Field of Search ..... 60/649, 673

[56] References Cited

U.S. PATENT DOCUMENTS 4,548,043 10/1985 Kalina ..... 60/673

4,604,867 8/1986 Kalina ..... 60/649 X

*Primary Examiner*—Allen M. Ostrager

*Attorney, Agent, or Firm*—Arnold, White & Durkee

[57] ABSTRACT

A method and apparatus for implementing a thermodynamic cycle, which includes the use of a composite stream, having a higher content of a high-boiling component than a working stream, to provide heat needed to evaporate the working stream. After being superheated, the working stream is expanded in a turbine. Thereafter, the expanded stream is separated into a spent stream and a withdrawal stream. The withdrawal stream is combined with a lean stream to produce a composite stream. The composite stream evaporates the working stream and preheats the working stream and the lean stream. The composite stream is then expanded to a reduced pressure. A first portion of this composite stream is fed into a gravity separator. The liquid stream flowing from the gravity separator forms a portion of the lean stream that is combined with the withdrawal stream. The vapor stream flowing from the separator combines with a second portion of the composite stream in a scrubber. The vapor stream from the scrubber combines with a third portion of the expanded composite stream to produce a pre-condensed working stream that is condensed forming a liquid working stream. The liquid streams from the scrubber and gravity separator combine to form the lean stream. The liquid working stream is preheated and evaporated transforming it into the gaseous working stream. The cycle is complete when the gaseous working stream is again superheated.

25 Claims, 2 Drawing Figures

DIRECT FIRED POWER CYCLE

BACKGROUND OF THE INVENTION

1. Field of the Invention

This invention relates generally to methods and apparatus for transforming thermal energy from a heat source into mechanical and then electrical form using a working fluid that is expanded and regenerated. This invention further relates to a method and apparatus for improving the thermal efficiency of a thermodynamic cycle.

2. Brief Description of the Background Art

It is well known that, in accordance with the Second Law of thermodynamics, the exergy (energy potential) of any heat source is increased as the temperature of this heat source is increased. Because of this effect, technological improvements in power generation have been directed toward increasing the temperature of the heat released in the process of combustion. One such improvement is the counterflow preheating of the combustion air with combustion gases to increase the combustion temperature and the average temperature of heat released from the burning of fuel. This technique, referred to as "pulverized-coal combustion," is well known and widely established.

Unlike the energy potential of the heat source, the efficiency of a power cycle depends, not on the temperature of the heat source directly, but on the average temperature of the working fluid in the process of heat transfer from the heat source. If this temperature of heat acquisition is significantly lower than the temperature of the available heat source, irreversible losses of exergy occur in the process of heat transfer, and the efficiency of the cycle remains relatively low.

This effect explains the relatively low efficiency of conventional power plants. For example, the limit of efficiency of a power plant converting thermal energy into power is on the level of approximately 63% , even when the working fluid temperature is maintained at the 1,000° to 1,100° F. limit that the metallurgical properties of modern power plants dictate. Similarly, the efficiency of the best direct-fired plants, based on a turbine electrical-power output (from which the work of the circulating feed pumps is subtracted) does not exceed 41–42%. In other words, the thermodynamic efficiency of these plants does not exceed 65% (the ratio of the thermal efficiency to the thermodynamic limit of efficiency).

The theoretical reason for this phenomenon is that the bulk of the heat transferred to the working fluid, i.e., water, is acquired in the boiler, where water boils at a temperature of approximately 660° F. (350° C.), while the available heat has a much higher temperature. It is absolutely clear, from a thermodynamic point of view, that unless the temperature of the heat acquisition by the working fluid is increased drastically, the efficiency of the process of conversion of thermal energy into power, i.e., the efficiency of the thermodynamic cycle, cannot be increased.

Use of a working fluid with a boiling temperature higher than that of water would not as a practical matter improve efficiency of the cycle for the following reason. The pressure in the condenser must be maintained at deep vacuum, even when water is used as a working fluid. If fluid with a normally higher-than-water boiling temperature is used, an even deeper vacuum in the condenser would be required, which would be technically impractical. Unless this super-low pressure in the condenser was provided, the temperature of condensation of such a hypothetical high-boiling fluid would be high, and all the gains obtained in the boiler would be lost in the condenser. Because of this problem, very little progress has been made in improving the efficiency of direct-fired power plants in the last sixty to seventy years.

A promising way to increase the efficiency of a power cycle utilizing high-temperature heat sources would be to use the so-called "recuperative cycle". According to this idea, the working fluid should be preheated to a relatively high temperature by the returning streams of the same working fluid. Only after such preheating should the external heat be transferred to the working fluid. As a result, all heat acquisition would occur at a high temperature, and theoretically the efficiency of such a cycle would be increased.

The only practical example of such a cycle is the so-called "recuperative Brighton Cycle", which utilizes a gaseous working fluid. In this cycle, the working fluid is compressed at ambient temperature, preheated in a recuperator, additionally heated by a heat source, expanded in a turbine, and sent back into the recuperator, thus providing preheating.

Despite its theoretical advantages, the recuperative Brighton Cycle does not, in reality, provide a superior efficiency because of two factors:

(1) the "work of compression" of a gaseous working fluid is very high and cannot be performed isothermally or with a small rise in temperature; and (2) because a gaseous working fluid is used, the temperature difference in the recuperator must be relatively high, thus causing irreversible exergy losses.

The ideal solution to a high-efficiency power cycle would be to combine a high degree of recuperation, characteristic of the Brighton Cycle, with a steam cycle wherein the working fluid pressure is increased while this fluid is in a liquid state. This allows the use of pumps, with a relatively minor work requirement (low "work of compression") to increase fluid pressure.

The direct realization of such a cycle unfortunately appears impossible, for a very simple reason. If the process of recuperative heating includes liquid preheating, evaporation, and some superheating, then the returning stream, which must have a lower pressure than the oncoming stream, would condense at a lower temperature than that at which the oncoming stream boils. This phenomenon appears to make the direct recuperation of heat in such a process impossible.

As indicated above, the overall boiling process in a thermodynamic cycle can be viewed for discussion purposes as consisting of three distinct parts: preheating, evaporation, and superheating. With conventional technology, the matching of a heat source and the working fluid is adequate only during the high temperature portion of superheating. The inventor of the present invention has appreciated, however, that in previously known processes a portion of the high temperature heat which would be suitable for high temperature superheating is used instead for evaporation and preheating. This causes very large temperature differences between the two streams, and as a result, irreversible losses of exergy. For example, in the conventional Rankine cycle, the losses arising from mismatching of the enthalpy-temperature characteristics of the heat source and the working fluid would constitute about 25% of the available exergy.

The ideal solution to the age old dilemma of poorly matched heat source and working fluid enthalpy-temperature characteristics would be one that makes high temperature heat available from the heat source for use in superheating thereby reducing the temperature differences during superheating, but at the same time provides lower temperature heat which minimizes the temperature differences in the process of evaporation.

Conventional steam-power systems provide a poor substitute for this ideal system. This is because the heat provided by the multiple withdrawal of steam, that has been partially expanded in a turbine, may only be used for the low temperature pre-heating of the incoming or feed water stream to the turbine. This use of the multiple withdrawal of steam to provide heat to the feedwater is known as feedwater preheating. Unlike its use in low temperature pre-heating, the withdrawal of partially expanded steam can not provide heat for the high temperature protion of the preheating process or for the evaporation of or for the low temperature portion of the superheating of the feedwater stream.

Because of technological limitations, the water usually boils at a pressure of approximately 2,500 psia and at a temperature of about 670° F. Thus, the temperature of the heat source of these systems is generally substantially greater than the boiling temperature of the liquid working fluid. Because of the difference between the high temperature of the combustion gases and the relatively low boiling temperature of the working fluid, conventional steam systems use high-temperature heat predominantly for low-temperature purposes. Since the difference between the temperature of the available heat and the temperature required for the process is very large, very high thermodynamic losses result from an irreversible heat exchange. Such losses severely limit the efficiency of conventional steam systems.

Replacing conventional systems with a system that provides lower temperature heat for evaporation of the working fluid may substantially reduce thermodynamic losses resulting from evaporation. Reducing these losses can substantially increase the efficiency of the system.

SUMMARY OF THE INVENTION

It is one feature of the present invention to provide a significant improvement in the efficiency of a thermodynamic cycle by permitting closer matching of the working fluid and the heat source enthalpy-temperature characteristics in the boiler. It is also a feature of the present invention to provide a direct fired power cycle in which high temperature heat added to the cycle may be used predominately, if not entirely, for high temperature purposes.

This transfer of heat to a working fluid predominately or solely at relatively high temperatures creates the necessary conditions at which to achieve a high thermodynamic and thermal efficiency. Because the working fluid in this cycle is a mixture of at least two components, the cycle enables a large percentage of recuperative heat exchange, including recuperative preheating, recuperative boiling and partial recuperative superheating, to be achieved. Such recuperative boiling, although impossible in a single component system, is possible in this multicomponent working fluid cycle. Unlike a single component system, when two or more components are used, different compositions for the working fluid may be used in different locations in the cycle. This enables a returning stream of working fluid, having a lower pressure than an oncoming stream, to condense within a temperature range which is higher than the temperature range within which the oncoming stream boils, thus effecting recuperative boiling of the working fluid.

In accordance with one embodiment of the present invention, a method of implementing a thermodynamic cycle includes the step of expanding a gaseous working stream to transform its energy into a useable form. The expanded gaseous working stream is divided into a withdrawal stream and a spent stream. After dividing the expanded stream into the two streams, the withdrawal stream is combined with a lean stream, having a higher content of a high-boiling component than is contained in the withdrawal stream, to form a composite stream that condenses over a temperature range that is higher than the temperature range required to evaporate an oncoming liquid working stream.

After forming the composite stream, that stream is transported to a boiler where it is condensed to provide heat for the boiling of the oncoming liquid working stream. Evaporation of the liquid working stream produces the above mentioned gaseous working stream. Subsequently, the composite stream is separated to form a liquid stream and a vapor stream. Some or all of the liquid stream forms the above mentioned lean stream. The vapor stream is returned into the cycle, preferably by being combined with a portion of the composite stream to produce a pre-condensed working stream. The pre-condensed working stream is condensed to produce the liquid working stream that is transported to the boiler. The spent stream may be combined with this liquid working stream prior to the liquid working stream being sent to the boiler. Alternatively, the spent stream may be returned to the system at some other location. To complete the cycle, the heat, that the above mentioned composite stream transports to the boiler, is used to evaporate the liquid working stream to form the gaseous working stream.

In accordance with another embodiment of the present invention, the gaseous working stream, exiting from the boiler, may then by superheated in one or more heat exchangers by either the withdrawal stream or the spent stream or by both the withdrawal and spent streams. Following the superheating of the gaseous working stream in the heat exchangers, the gaseous working stream may be further superheated in a heater. The energy supplied to the heater is supplied from outside the thermodynamic cycle. After this superheating, expansion of the gaseous working stream takes place. This expanded gaseous working stream may be reheated and expanded one or more times before being divided into the spent and withdrawal streams. This embodiment may further include the step of reheating and expanding the spent stream one or more times after the spent stream has been separated from the withdrawal stream.

In addition, this embodiment may further include a series of recuperative heat exchangers used to recuperate heat from the withdrawal, composite and spent streams. These heat exchangers may allow the lean stream and the liquid working stream to absorb heat from the composite stream. Further, one or more of these heat exchangers may allow the spent stream to provide additional heat to the liquid working stream to aid in the preheating and boiling of the liquid working stream.

In accordance with yet another embodiment of the present invention, the methods for implementing a thermodynamic cycle described above may further include the step of reducing the pressure of the composite stream with a hydraulic turbine (or alternatively a throttle valve). After this reduction of pressure, a first portion of this composite stream may be partially evaporated in one or more heat exchangers with heat from the spent stream and with heat from this same composite stream as it flows toward the turbine. After the partial evaporation of this first portion of the composite stream, it is sent to a separator where it is separated into a vapor stream and a liquid stream.

In this embodiment, the liquid stream forms a portion of the lean stream which may be sent to a circulation pump to be pumped to a higher pressure. The circulation pump may be connected to the hydraulic turbine; the hydraulic turbine releasing energy used to operate the pump. After attaining this high pressure, the lean stream may be heated by the returning composite stream in one or more heat exchangers. After acquiring this additional heat, the lean stream is combined with the withdrawal stream to form the composite stream used to preheat and evaporate the liquid working stream.

The vapor stream may be combined with a second portion of the composite stream, that flows from the hydraulic turbine, in a direct contact heat exchanger or in a scrubber. The liquid stream flowing from the heat exchanger or scrubber may combine with the liquid stream from the separator to produce the lean stream. The vapor stream flowing from the heat exchanger or scrubber forms a super rich stream. In this embodiment, this super rich stream may be combined with a third portion of the composite stream, that flows from the hydraulic turbine, to form a pre-condensed working stream. This stream may then pass through a heat exchanger, to supply heat to the returning liquid working stream, before it is fed into a water-cooled condenser to be fully condensed to produce the liquid working stream.

The liquid working stream may be pumped to a high pressure by a feed pump. After obtaining this high pressure, the liquid working stream may be heated in a series of heat exchangers by the pre-condensed working stream, returning composite stream and the returning spent stream. This heat exchange, which may be accompanied by the pumping of the liquid working stream to progressively higher pressures, continues until the liquid working stream is evaporated to produce the gaseous working stream, thereby completing the cycle.

DESCRIPTION OF PREFERRED EMBODIMENTS

Figure 1:
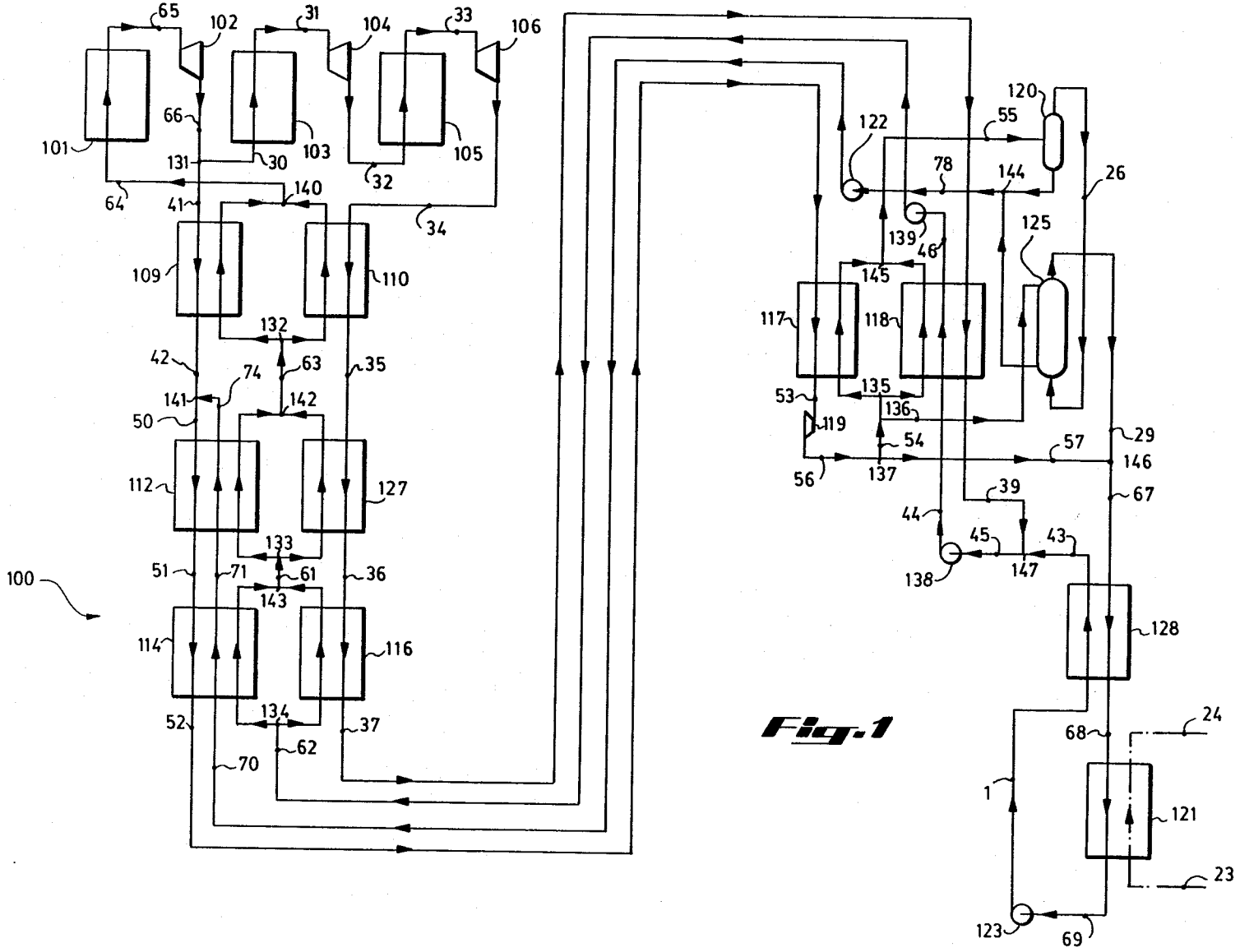
FIG. 1 is a schematic representation of one embodiment of the method and apparatus of the present invention.

The schematic shown in FIG. 1 shows an embodiment of preferred apparatus that may be used in the above described cycle. Specifically, FIG. 1 shows a system 100 that includes a boiler in the form of heat exchangers 112 and 127, a preheater in the form of heat exchangers 114 and 116, and a superheater in the form of heat exchangers 109 and 110. In addition, the system 100 includes turbines 102, 104 and 106, superheater 101, reheaters 103 and 105, gravity separator 120, scrubber 125, hydraulic turbine 119, pumps 122, 123, 138 and 139, heat exchangers 117, 118 and 128, and condenser 121. Further, the system 100 includes stream separators 131–137 and stream mixers 140–147.

The condenser 121 may be any type of known heat rejection device. For example, the condenser 121 may take the form of a heat exchanger, such as a water cooled system, or another type of condensing device. In the alternative, condenser 121 may be replaced with the heat rejection system described in U.S. Pat. Nos. 4,489,563 and 4,604,867 to Kalina. The Kalina system requires that the stream shown approaching condenser 121 in FIG. 1 be mixed with a multi-component fluid stream, for example, a fluid stream comprised of water and ammonia, condensed and then distilled to produce the original state of the working fluid. Thus, when the heat rejection system of the Kalina cycle is used in place of condenser 121, the distillation subsystem described in U.S. Pat. Nos. 4,489,563 and 4,604,867 may be utilized in place of condenser 121. U.S. Pat. Nos. 4,489,563 and 4,604,867 are hereby expressly incorporated by reference herein.

Various types of heat sources may be used to drive the cycle of this invention. Thus, for example, heat sources with temperatures as high as 1,000° C. or more down to heat sources sufficient to superheat a gaseous working stream may be used to heat the gaseous working stream flowing through heater 101 and reheaters 103 and 105. The combustion gases resulting from the burning of fossil fuels is a preferred heat source. Any other heat source capable of superheating the gaseous working stream that is used in the described embodiment of the invention may also be used.

While the embodiment illustrated in FIG. 1 is related to pulverized coal combustion, this system may be used with a variety of combustion systems, including different types of fluidized bed combustion systems and waste incineration systems. One of ordinary skill can adjust the system by adding heat exchangers needed to accommodate a variety of different combustion systems.

The working fluid used in the system 100 may be any multi-component working fluid that comprises a lower boiling point fluid and a relatively higher boiling point fluid. Thus, for example, the working fluid employed may be an ammonia-water mixture, two or more hydrocarbons, two or more freons, mixtures of hydrocarbons and freons or the like. In general, the fluid may be mixtures of any number of compounds with favorable thermodynamic characteristics and solubility. In a preferred embodiment, a mixture of water and ammonia is used.

As shown in FIG. 1, a working stream circulates through system 100. The working stream includes a gaseous working stream that flows from stream mixer 142 until it is separated into a withdrawal stream and a spent stream at separator 131. In addition to the gaseous working stream, the withdrawal stream (that flows from separator 131 to stream mixer 141) and the spent stream (that flows from separator 131 to stream mixer 147) the working stream includes a pre-condensed working stream (that flows from mixer 146 to condenser 121) and a liquid working stream (that flows from condenser 121 to boilers 112, 127). Each portion of the working stream contains the same percentage of high boiling and low boiling components.

The gaseous working stream, that has been completely evaporated and superheated in previous stages of system 100, enters heater 101. While in heater 101, the gaseous working stream is superheated to the highest temperature that is reached at any stage in the process. After being superheated, this gaseous working stream is expanded in turbine 102 to an intermediate pressure. This expansion allows the heat contained in the gaseous working stream to be converted into energy that is in a useable form.

After expansion in turbine 102, the gaseous working stream is separated by separator 131 into two streams, a withdrawal stream and a spent stream. The spent stream is reheated in reheater 103, expanded in turbine 104, reheated a second time in reheater 105 and expanded a second time in turbine 106. Although FIG. 1 shows the system 100 as having two reheaters 103 and 105, for reheating the spent stream, and two turbines 104 and 106, for expandiang the spent stream, the optimum number of reheaters and turbines depends upon the desired efficiency of the system. The number of reheaters and turbines may be either increased or decreased from the number shown in FIG. 1. In addition, a single heater may be used to heat the gaseous working stream, prior to expansion, and the spent working stream, prior to the expansion of the spent stream. Therefore, the number of heaters and reheaters may be more than, less than or equal to the number of turbines.

Further, system 100 may include additional heaters and turbines for reheating and expanding the gaseous stream exiting from turbine 102 prior to that stream's separation into the withdrawal and spent streams. Thus, although the inclusion of reheaters 103 and 105 and turbines 104 and 106 to system 100 provides a preferred embodiment of the present invention, one may select a different number of reheaters and turbines without departing from the scope of the disclosed general inventive concept.

After these reheatings and expansions of the spent stream, the stream passes through a series of recuperative heat exchangers. As shown in FIG. 1, the spent stream, after expansion, passes through recuperative heat exchangers 110, 127 and 116. While passing through heat exchanger 110, the spent stream provides heat to superheat the gaseous working stream. While passing through heat exchanger 127, the spent stream provides heat to evaporate the oncoming high-pressure liquid working stream. Similarly, while passing through heat exchanger 116, the spent stream provides heat to preheat this oncoming high pressure liquid working stream.

Whether any or all of the heat exchangers 110, 127 and 116 are used or whether a number of additional heat exchangers are added to the system is a matter of design choice. Although the inclusion of heat exchangers 110, 127 and 116 to system 100 is preferred, the spent stream may pass through an increased number of heat exchangers, or not pass through any heat exchangers at all, without departing from the scope of the disclosed invention.

The withdrawal stream beginning at stream separator 131 initially passes through recuperative heat exchanger 109. While passing through heat exchanger 109, the withdrawal stream provides heat for the superheating of the oncoming high-pressure gaseous working stream. Although system 100 preferably includes heat exchanger 109, one may remove heat exchanger 109 or add additional heat exchangers. The preferred state of the withdrawal stream at point 42, after it has passed through heat exchanger 109, is that of a superheated vapor.

After heating the gaseous working stream, the withdrawal stream combines with a lean stream at stream mixer 141. This lean stream contains the same components as are contained in the working stream. The lean stream, however, contains a higher content of a high-boiling component than is contained in any part of the working stream. For example, if ammonia and water are the two components present in the working and lean streams, the water is the high-boiling component and the ammonia is the low-boiling component. In such a two component system, the lean stream contains a higher percentage of water than is contained in the working stream. As shown in FIG. 1, the lean stream flows from stream mixer 144 to stream mixer 141.

In this embodiment, the state of the lean stream at point 74, prior to mixing with the withdrawal stream at stream mixer 141, is preferably that of a subcooled liquid.

Mixing the lean stream with the withdrawal stream at stream mixer 141 provides a composite stream that has a lower boiling temperature range than the lean stream but a higher boiling temperature range than the withdrawal stream or any other portion of the working stream. The state of the composite stream as it flows from stream mixer 141 depends upon the states of the lean and withdrawal streams. It is preferably that of a vapor-liquid mixture. Preferably, the pressure of the withdrawal stream at point 42 and the lean stream at point 74, prior to mixing at stream mixer 141, will be the same as the pressure of the composite stream at point 50, that is formed at stream mixer 141. The temperature of the composite stream at this point is preferably higher than the temperature of the lean stream at point 74 and slightly lower than that of the withdrawal stream at point 42.

The composite stream will contain a higher percentage of a high-boiling component than is contained in the withdrawal stream or in other portions of the working stream. Because the composite stream contains a higher percentage of a high-boiling component, it may be condensed within a temperature range which exceeds the boiling temperature range of the liquid working stream. Further, in this preferred embodiment, the composite stream may be condensed at a higher temperature than the boiling temperature of the liquid working stream, even if the pressure of the composite stream is significantly lower than the pressure of the oncoming liquid working stream.

The composite stream produced by the mixing of the withdrawal stream with the lean stream flows into heat exchanger 112, where it is cooled and condensed. As it is being cooled and condensed, the composite stream provides heat to evaporate the oncoming liquid working stream and to provide heat to the oncoming lean stream, as those streams enter heat exchanger 112.

Using a composite stream, having a higher boiling temperature range than the boiling temperature range of the liquid working stream, provides one of the principle distinctions between the thermodynamic cycle disclosed in the present invention and conventionally used cycles. Unlike a conventional thermodynamic cycle, the cycle of the present invention withdraws part of the gaseous working stream, after it has been partially expanded, to provide heat for a composite stream comprising that withdrawn part of the gaseous working stream together with a lower temperature lean stream. This composite stream, preferably having a pressure that is lower than the pressure of the oncoming liquid working stream, is used to heat and completely or partially evaporate the oncoming liquid stream.

Because of the higher percentage of a high-boiling component contained in this composite stream, the composite stream condenses over a range of temperatures that are higher than the temperatures required to evaporate the oncoming liquid working stream, even though the liquid working stream may enter heat exchanger 112 at a higher pressure than the pressure of the composite stream.

Such a method of evaporating a liquid working stream can not be performed in conventional steam-power systems. In conventional systems, the condensation of the withdrawn stream must occur over a lower temperature range than the boiling temperature of the oncoming liquid working stream, if the withdrawn stream has a lower pressure than the pressure of the oncoming liquid working stream. Thus, heat released by condensation of a withdrawn stream in conventional systems can be used only for partial preheating of the oncoming working stream.

In contrast, in the method disclosed by the present invention, the presence of a higher percentage of a high-boiling component in the composite stream allows that stream to condense over a higher temperature range than the boiling temperature range of the oncoming liquid working stream, even if the pressure of the composite stream is substantially lower than the pressure of the liquid working stream. It should be appreciated that the described method uses a single withdrawal stream to form a composite stream that acts as the heat source effecting the complete preheating and evaporation of the working stream and also provides heat for the low temperature superheating of the working stream.

To create this composite stream, however, part of the expanded gaseous working stream must be withdrawn. It should be appreciated that withdrawing part of this superheated stream for combination with a lean stream to produce the composite stream results in thermodynamic losses because of the reduction in temperature of the withdrawn stream. The losses resulting from the removal of part of the gaseous stream and mixing that withdrawal stream with a lean stream are, however, more than compensated for by the losses that are prevented when the composite stream is used to evaporate the liquid working stream.

As the calculations in Table II show, using a portion of the expanded gaseous working stream to create a composite stream, having a higher percentage of a high-boiling component than is contained in the liquid working stream, allows the thermodynamic cycle of the present invention to have a substantially increased efficiency compared to conventional steam-power systems. Using this composite stream to provide low temperature heat for the low temperature evaporation process allows the available heat in the system to be more adequately matched with the liquid working stream's enthalpy-temperature characteristics. This matching prevents the very high thermodynamic losses that occur in conventional systems that use high temperature heat in low temperature evaportion processes. The enormous amount of exergy saved by using this composite stream to more closely match the temperature of the heat source with the liquid working stream's enthalpy-temperature characteristics substantially exceeds any losses caused from removing part of the gaseous working stream from its superheated state.

The pressure at which the withdrawal stream is mixed with the lean stream to produce the composite stream must be a pressure which insures that the temperature over which the composite stream condenses will be higher than the temperature over which the liquid working stream evaporates. The leaner the composite stream, the lower will be the pressure needed for condensation. The lower the pressure, the larger the expansion ratio of turbine 102, corresponding to an increase in the work that this turbine provides.

There is a practical limit to the amount of the high boiling component that can be used in the composite stream. This is because a leaner composite stream is more difficult to separate. Thus, to optimize the system's efficiency, the choice of pressure and composition for the composite stream must be carefully made. Table I provides one example of a composite stream pressure and composition that may be used to provide a highly efficient cycle.

It should be appreciated that heat exchanger 127, wherein the spent stream is used to evaporate part of the liquid working stream, may be removed from system 100 without departing from the scope of the described general inventive concept. The portion of the liquid working stream that had passed through heat exchanger 127 would then be diverted to heat exchanger 112, where it would be evaporated.

After passing through heat exchanger 112, the composite stream is sent into heat exchanger 114 to provide heat for preheating the lean stream and the liquid working stream. As the composite stream transfers heat to the lean stream and the liquid working stream, the composite stream is further cooled. Again, although limiting the number of heat exchangers in this part of system 100 to heat exchangers 112 and 114 is preferred, additional heat exchangers may be added or heat exchanger 114 may be removed from the system 100 without departing from the scope of the disclosed invention.

After the composite stream exits from heat exchanger 114, it is sent into heat exchanger 117, where its heat is used to partially evaporate a countercurrent portion of that same composite stream that flows from separator 135.

Even after exiting heat exchanger 117, the pressure of the composite stream at point 53, in this embodiment of the present invention, remains relatively high. Since the composite stream may not be able to produce the working stream and lean stream at this high pressure, this pressure may have to be reduced. This reduction in pressure occurs in the hydraulic turbine 119. A particular hydraulic turbine that may be used in a Pelton wheel.

During this pressure reduction step, all or part of the work needed to pump the lean solution at pump 122 may be recovered. Because the weight flow rate of the stream passing through Pelton wheel 119 is higher than the weight flow rate of the lean stream passing through pump 122, the energy released in Pelton wheel 119 is usually sufficient to provide the work of pump 122. If the energy that Pelton wheel 119 releases is insufficient, a supplementary electrical motor can be installed to supply the additional power that pump 122 requires.

A throttle valve may be used as an alternative to hydraulic turbine 119. If a throttle valve is used instead of the hydraulic turbine, work spent to pump the lean solution will, of course, not be recovered. Regardless of whether hydraulic turbine 119 or a throttle valve is used, however, the remainder of the process will not be affected. The choice of whether to use a hydraulic turbine or a throttle valve to reduce the pressure of the composite stream is strictly an economic one. Further, although the use of heat exchanger 117 and turbine 119 is preferred, one may decide not to use these devices, or may decide to add additional heat exchangers or other pressure reduction apparatus to the system 100.

The composite stream flowing from hydraulic turbine 119 preferably has a pressure at point 56 that is approximately equal to or slightly greater than the pressure of condensation. A portion of this composite stream, having this reduced pressure, is separated from the composite stream at separator 137. This stream is again divided at separator 136. A first portion of the composite stream separated at separator 136 is then split into two streams at separator 135. These two streams are then sent into heat exchangers 117 and 118, where the counterstream of the same composite stream is cooled and the returning spent stream is condensed, partially evaporating these two streams. The countercurrent composite stream adds heat in heat exchanger 117 and the condensing spent stream adds heat in heat exchanger 118. After exiting exchangers 117 and 118, the two streams flowing from separator 135 are combined at stream mixer 145. This partially evaporated stream is then sent to gravity separator 120.

The state of the stream entering gravity separator 120 is that of a vapor-liquid mixture. In order to provide heat for this partial evaporation, the spent stream, which had been condensed in heat exchanger 118, must have a pressure which will enable the spent stream to be condensed at an average temperature which is higher than the average temperature needed to evaporate the portion of the composite stream that is to be separated. The leaner the composite stream, the higher the temperature necessary for its evaporation, and thus the higher the pressure of the spent stream at point 37. Increasing the pressure at point 37 reduces the expansion ratio in turbines 104 and 106 and, as a result, reduces the work output of these turbines. This shows that, although making the composite stream leaner increases the power output of turbine 102, it reduces the power output of turbines 104 and 106.

To maximize the total output of all three turbines, an appropriate composition must be selected for the composite stream. One such composition is provided in Table I.

The embodiment shown in FIG. 1 uses the returned spent stream to preheat the liquid working stream and to partially evaporate the stream sent to gravity separator 120. At the same time, the spent stream is condensed as it passes through heat exchanger 118. It should be noted that, instead of condensing the spent stream in condenser 121, without simultaneously recovering heat from that condensing stream, system 100 uses the heat that the spent stream releases as it is being condensed in heat exchanger 118 to preheat the liquid working stream and partially evaporate the composite stream sent to separator 120.

Gravity separator 120 separates the first portion of the composite stream into a vapor stream and a liquid stream. The liquid stream flowing from the bottom of gravity separator 120 forms a portion of the lean stream that is mixed with the previously described withdrawal stream at mixer 141.

The vapor stream flowing from gravity separator 120 is sent to the bottom of scrubber 125. A second portion of the composite stream, flowing from separator 136, is sent into the top of scrubber 125. The liquid and vapor streams fed into scrubber 125 interact, providing heat and mass exchange. A direct contact heat exchanger or other means for effecting heat and mass exchange between the liquid and vapor streams, shown fed into scrubber 125 in FIG. 1, may be used in place of scrubber 125. Whether scrubber 125, a heat exchanger, or some other means is used in system 100 is a matter of design choice.

In the embodiment shown in FIG. 1, liquid and vapor streams exit scrubber 125. The liquid stream is combined with the liquid stream flowing from separator 120 at stream mixer 144 to form the lean stream that is mixed with the withdrawal stream at stream mixer 141 to produce the composite stream. The liquid streams flowing from scrubber 125 and separator 120 to form the lean stream preferably have the same, or nearly the same, composition.

The lean stream flows from stream mixer 144 into circulation pump 122. Pump 122 pumps the lean stream to a high pressure. In the embodiment shown in FIG. 1, the pressure of the lean stream at point 70, as it flows from pump 122, is higher than the pressure of the lean stream at point 74, as it flows from heat exchanger 112, as is shown in Table I.

As shown in FIG. 1, this high pressure lean stream passes through heat exchangers 114 and 112, where the countercurrent composite stream provides heat to the lean stream, and combines with the withdrawal stream at stream mixer 141.

The vapor stream exiting scrubber 125 is a stream having a high percentage of the lower boiling component. This super rich stream combines with a third portion of the composite stream, i.e., that portion flowing from separator 137, at stream mixer 146. This stream forms a pre-condensed working stream which flows through heat exchanger 128 and into condenser 121. While passing through heat exchanger 128, this pre-condensed working stream is further condensed while adding heat to the countercurrent liquid working stream flowing from condenser 121 and pump 123. After exiting heat exchanger 128, the pre-condensed working stream enters condenser 121, where it is fully condensed.

This pre-condensed working stream has the same composition as the above described withdrawal stream. It should be noted that only this pre-condensed working stream is condensed, minimizing the exergy losses at the condenser. As described above, the spent stream does not pass through the condenser. Instead, the heat released from the condensation of the spent stream is used to preheat the liquid working stream and to partially evaporate the composite stream sent to separator 120. The use of the spent stream in this manner ensures that the liquid working stream sent to heat exchangers 112 and 127 will be completely evaporated in a recuperative way, ensuring that system 100 will have a greater efficiency than the best conventional Rankine cycles.

Condenser 121 is preferably a water-cooled condenser. When such a condenser is used, a stream of cooling water flowing through condenser 121 completely condenses this working stream to produce the liquid working stream.

This liquid working stream flows into feed pump 123, where it is pumped to an increased pressure. This liquid working stream then flows into heat exchanger 128, where heat transferred from the pre-condensed working stream preheats the liquid working stream. After being preheated in heat exchanger 128, the liquid working stream is combined with the spent stream at stream mixer 147. This mixed stream is pumped to an intermediate pressure by pump 138. It then passes through heat exchanger 118, where it is preheated by heat transferred by the condensing returning spent stream. After exiting heat exchanger 118, the liquid working stream is pumped to a high pressure by pump 139. This high pressure, preferably subcooled, liquid working stream is then separated at separator 134 into two streams. One of the streams passes through heat exchanger 114, where heat transferred from the composite stream preheats this portion of the liquid working stream. The other stream flowing from separator 134 flows into exchanger 116, where heat from the returning spent stream is transferred to this portion of the liquid working stream, preheating this portion of the liquid working stream. The spent stream as it exits from exchanger 116 is preferably in the state of a saturated vapor, but alternatively may be in the state of a superheated vapor or may be partially condensed.

The portion of the liquid working stream passing through heat exchanger 116 is combined with the stream flowing from heat exchanger 114 at stream mixer 143. This stream is preferably in a state of a saturated, or slightly subcooled, liquid. The stream flowing from stream mixer 143 then is separated into two streams at separator 133. One stream flows into heat exchanger 112. The liquid working stream passing through heat exchanger 112 is evaporated with heat transferred from the composite stream flowing from stream mixer 141.

The other stream flowing from separator 133 then flows into heat exchanger 127, where it is evaporated with heat transferred from the spent stream.

The streams exiting heat exchangers 112 and 127 are combined at stream mixer 142. As described above, heat exchanger 127 could be removed, with all of the liquid working stream flowing from stream mixer 143 diverted to heat exchanger 112, without departing from the described general inventive concept.

In this embodiment, the stream flowing from stream mixer 142 is in the vapor state and makes up the cycle's gaseous working stream. The gaseous working stream flowing from stream mixer 142, which might even be slightly superheated, is divided into two streams at stream separator 132. One of these streams passes through heat exchanger 109, where it is superheated by the withdrawal stream passing from stream separator 131 through heat exchanger 109 to stream mixer 141. The other portion of the gaseous working stream passes through heat exchanger 110, where heat from the spent stream flowing from turbine 106 is used to superheat this portion of the gaseous working stream. The two streams flowing from stream separator 132 and through heat exchangers 109 and 110 are recombined at stream mixer 140. This recombined gaseous working stream flows into heater 101 to complete this thermodynamic cycle.

Figure 2:
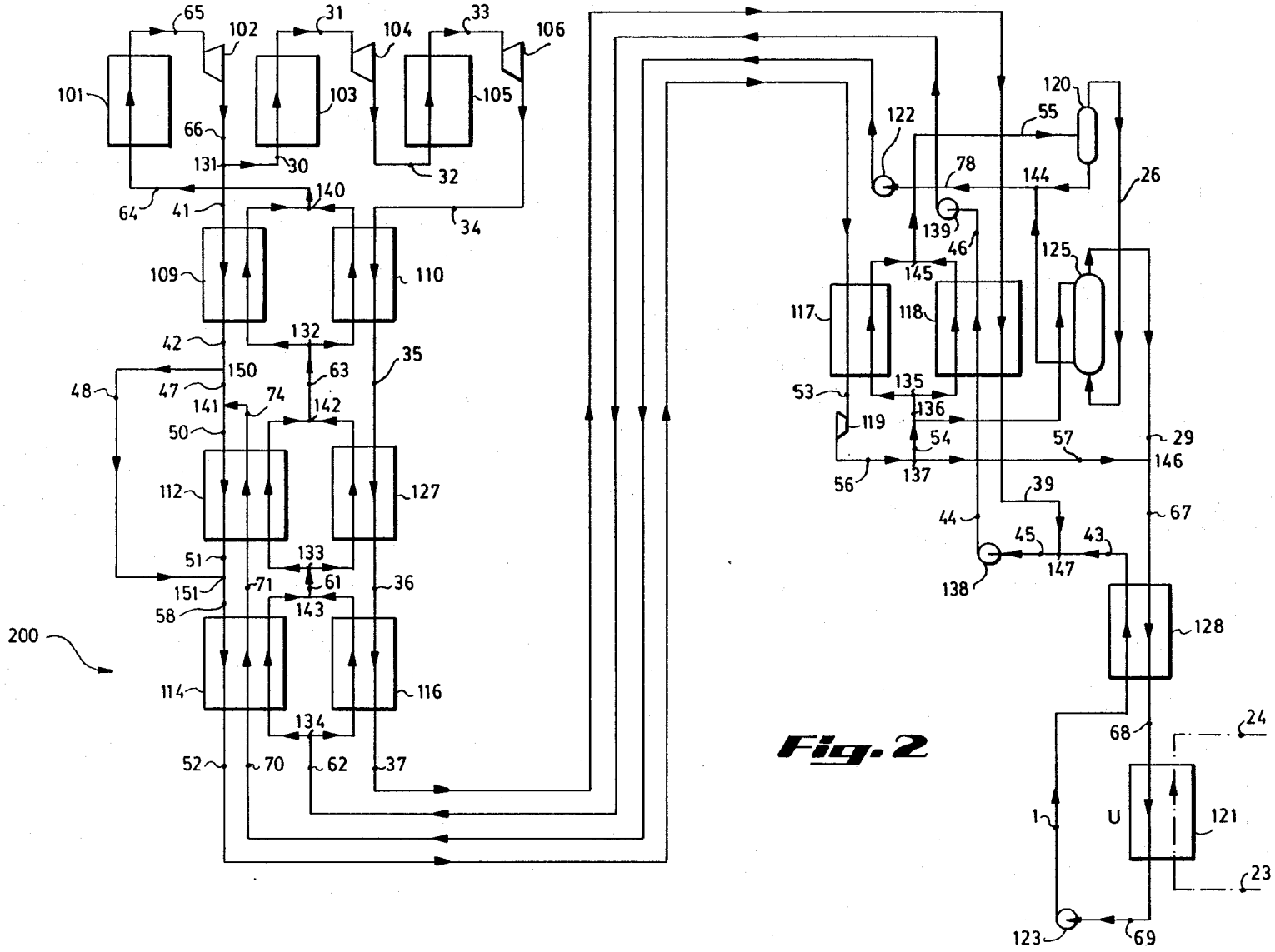
FIG. 2 is a schematic representation of a second embodiment of the method and apparatus of the present invention.

In the embodiment of system 200, shown in FIG. 2, the process of absorption, i.e., of adding the lean stream to the withdrawal stream to make the composite stream, is performed in two steps. The withdrawal stream is divided into first and second withdrawal streams at stream separator 150. The first withdrawal stream is combined with the lean stream at stream mixer 141, producing a first composite stream, which is leaner than it would be if the withdrawal stream with parameters as at point 42 was combined with the lean stream (as was done in the embodiment shown in FIG. 1).

Because the first composite stream in FIG. 2 is now leaner than the composite stream of FIG. 1, its pressure can be reduced, which will increase the work output from turbine 102. The first composite stream is then condensed in boiler 112. Thereafter, the first composite stream is combined with the second withdrawal stream at mixer 151, creating a second composite stream. The second composite stream is richer than the first composite stream. As a result, it is easier to provide for its separation.

The first composite stream provides heat for boiler 112, and enables the pressure of absorption to be reduced thus increasing the output of turbine 102. At the same time, the embodiment in FIG. 2 enables an enriched second composite stream to be sent into separator 120. This FIG. 2 embodiment thus provides the benefits of a lower pressure composite stream which does not at the same time prevent the composite stream from being easily separated.

Both the cycle shown in FIG. 1 and the cycle shown in FIG. 2 are substantially more efficient than conventional steam-power systems. The decision to use one of these preferred systems instead of the other is a matter of design choice.

In the above described thermodynamic cycles of the present invention, all of the heating and evaporating of the liquid working stream may be provided in a recuperative way, i.e., the returning composite and spent streams transfer heat to the liquid working stream as these two streams cool. Further, even part of the superheating of the gaseous working stream may be provided in this recuperative manner, i.e., the withdrawal stream and spent stream may transfer heat to the gaseous working stream as these two streams cool.

Use of a withdrawal stream to preheat an oncoming working stream is common in conventional steam-power systems. Such a practice is commonly known as "feed water heating". Feedwater heating is conventional systems is useful only for preheating the incoming liquid working stream, because the pressure and temperature of condensation of the withdrawal stream is too low for it to be used for any other purpose.

Unlike conventional steam-power systems, the thermodynamic cycle of the present invention does not use a withdrawal stream to directly heat an oncoming liquid working stream. Rather, this invention uses a withdrawal stream, having a pressure that is lower than the pressure of the oncoming liquid working stream, to indirectly heat this oncoming liquid working stream. Unlike conventional steam-power systems, this invention uses the withdrawal stream to create a composite stream having a higher percentage of a high-boiling component than is contained in the withdrawal stream or the oncoming liquid working stream. It is this composite stream, that condenses over a range of temperatures that exceeds the range of temperatures required to evaporate the oncoming liquid working stream, that provides a substantial amount of the heat needed to evaporate this liquid working stream.

As previously described, this composite stream may condense over a higher temperature range than the temperature range needed to evaporate the liquid working stream, even when the composite stream is at a lower pressure than the pressure of the liquid working stream. In conventional steam-power systems, that only have one component in the working stream, the condensation of a withdrawal stream must occur over a temperature range that is lower than the temperature range required to boil the oncoming working stream, when the withdrawal stream is held at a lower pressure than the pressure of the oncoming working stream. Thus, unlike these conventional systems, the thermodynamic cycle of the present invention enables the use of a low temperature heat source held at a relatively low pressure for the evaporation of a relatively higher pressure working stream. Such a process provides substantially increased efficiency when compared to single component steam-power systems.

In addition, it should be appreciated that the thermodynamic cycle of the present invention may be driven entirely by high temperature heat supplied to the heater and reheaters. Using high temperature heat in this way allows the heat source to be closely matched to the enthalpy-temperature characteristics of the working fluid. This feature thus provides a power cycle with dramatically reduced exergy losses and substantially increased efficiency.

In order to further illustrate the advantages that can be obtained by the present invention, a set of calculations was performed, as shown in Table II. This set of calculations is related to an illustrative power cycle in accordance with the system shown in FIG. 1. In this illustrative cycle, the working fluid is a water-ammonia mixture with a concentration of 87.5 wt.% of ammonia (weight of ammonia to total weight of the mixture). The parameters for the theoretical calculations are set forth in Table I below. In this table the points set forth in the first column correspond to points set forth in FIG. 1.

Table I shows that when a composite stream is used as a heat source to evaporate a liquid working stream, low temperature heat is available for use in a low temperature process.

TABLE I

| Point | P (psia) | x | T °F. | H (Btu/lb) | G |
|---|---|---|---|---|---|
| 1 | 284.15 | 0.8750 | 60.99 | −6.87 | .4884 |
| 23 | — | WATER | 52.00 | — | 5.2958 |
| 24 | — | WATER | 89.13 | — | 5.2958 |
| 26 | 99.31 | 0.6650 | 259.11 | 828.61 | .1637 |
| 29 | 98.31 | 0.9918 | 122.69 | 586.24 | .3724 |
| 30 | 1097.00 | 0.8750 | 882.96 | 1104.44 | .5116 |
| 31 | 1082.00 | 0.8750 | 1050.00 | 1223.75 | .5116 |
| 32 | 561.50 | 0.8750 | 916.72 | 1133.50 | .5116 |
| 33 | 546.50 | 0.8750 | 1050.00 | 1227.99 | .5116 |
| 34 | 283.65 | 0.8750 | 909.54 | 1131.30 | .5116 |
| 35 | 281.15 | 0.8750 | 415.00 | 807.68 | .5116 |
| 36 | 278.65 | 0.8750 | 363.27 | 773.31 | .5116 |
| 37 | 276.15 | 0.8750 | 267.11 | 708.69 | .5116 |
| 39 | 274.15 | 0.8750 | 126.69 | 66.80 | .5116 |
| 41 | 1097.00 | 0.8750 | 882.96 | 1104.44 | .4884 |
| 42 | 1090.00 | 0.8750 | 448.70 | 782.05 | .4884 |
| 43 | 274.15 | 0.8750 | 106.13 | 43.25 | .4884 |
| 44 | 1271.27 | 0.8750 | 121.69 | 61.08 | 1.0000 |
| 45 | 274.15 | 0.8750 | 116.64 | 55.30 | 1.0000 |
| 46 | 1261.27 | 0.8750 | 257.26 | 230.25 | 1.0000 |
| 50 | 1090.00 | 0.5000 | 406.74 | 530.48 | .9890 |
| 51 | 1090.00 | 0.5000 | 353.52 | 322.27 | .9890 |
| 52 | 1080.00 | 0.5000 | 267.11 | 157.14 | .9890 |
| 53 | 1070.00 | 0.5000 | 124.36 | −6.52 | .9890 |
| 54 | 100.31 | 0.5000 | 121.69 | −9.42 | .8730 |
| 55 | 99.31 | 0.5000 | 259.11 | 629.69 | .2375 |
| 56 | 100.31 | 0.5000 | 121.69 | −9.42 | .9890 |
| 57 | 100.31 | 0.5000 | 121.69 | −9.42 | .1160 |
| 61 | 2450.00 | 0.8750 | 348.27 | 387.50 | 1.0000 |
| 62 | 2475.00 | 0.8750 | 262.11 | 237.28 | 1.0000 |
| 63 | 2450.00 | 0.8750 | 400.00 | 611.00 | 1.0000 |
| 64 | 2435.00 | 0.8750 | 677.34 | 934.02 | 1.0000 |
| 65 | 2415.00 | 0.8750 | 1050.00 | 1211.18 | 1.0000 |

TABLE I-continued

| Point | P (psia) | x | T °F. | H (Btu/lb) | G |
|---|---|---|---|---|---|
| 66 | 1097.00 | 0.8750 | 882.96 | 1104.44 | 1.0000 |
| 67 | 98.31 | 0.8750 | 121.52 | 444.74 | .4884 |
| 68 | 97.31 | 0.8750 | 101.13 | 394.63 | .4884 |
| 69 | 96.31 | 0.8750 | 60.00 | −7.96 | .4884 |
| 70 | 1110.00 | 0.1342 | 263.07 | 192.86 | .5006 |
| 71 | 1100.00 | 0.1342 | 348.27 | 285.06 | .5006 |
| 74 | 1090.00 | 0.1342 | 348.27 | 285.06 | .5006 |
| 78 | 99.31 | 0.1342 | 259.11 | 188.66 | .5006 |

Table II provides the performance parameters for the cycle shown in FIG. 1. Table II shows that this process prevents the very high thermodynamic losses that occur in conventional steam-power systems that use a high temperature heat source in the low temperature evaporation process.

TABLE II

Performance Parameters of the Proposed FIG. 1 System Per 1 lb. of Working Fluid at Turbine 102 Inlet

| | |
|---|---|
| Output of Turbine 102 | 106.73 Btu |
| Output of Turbine 104 | 46.18 Btu |
| Output of Turbine 106 | 49.47 Btu |
| Total Turbine Output | 202.38 Btu |
| Total Turbines Electrical Output | 197.32 Btu |
| Pelton Wheel 119 Output | 2.87 Btu |
| Total System Gross Output | 200.19 Btu |
| Pump 123 Work | 0.53 Btu |
| Pump 138 Work | 5.78 Btu |
| Pump 122 Work | 2.10 Btu |
| Pump 139 Work | 7.04 Btu |
| Total Pump Work | 15.45 Btu |
| Total System Net Output | 184.73 Btu |
| Heat Input in Heat Exchanger 101 | 277.16 Btu |
| Heat Input in Heat Exchanger 103 | 61.04 Btu |
| Heat Input in Heat Exchanger 105 | 48.35 Btu |
| Total Heat Input | 386.54 Btu |
| Net Thermal Efficiency | 0.4779 or 47.79% |

The sample calculation shown in Table II shows that the exergy losses that occur in the boiler in the present invention are as a whole drastically reduced. This calculation shows that the FIG. 1 cycle, using the parameters shown in Table I, has an internal, or turbine, efficiency of 47.79% versus 42.2% for the best Rankine cycle power systems. This 13.25% improvement in energetical efficiency shows that the exergy savings at the boiler more than compensate for any exergy losses resulting from withdrawing part of an expanded gaseous working stream and cooling this withdrawal stream by combining it with a lean stream to produce a composite stream. Thus, the efficiency of the full cycle is substantially increased.

While the present invention has been described with respect to two preferred embodiments, those skilled in the art will appreciate a number of variations and modifications of these embodiments. For example, more than one withdrawal stream may be used in the system. Similarly, more than one lean stream may be used in the system. The number of withdrawal and lean streams that one of ordinary skill in the art decides to combine determines the number of composite streams flowing through the system. Further, as described, the number of heat exchangers, reheaters, pumps, gravity separators, condensers and turbines may be varied. Thus, it is intended that the appended claims cover all such variations and modifications as fall within the true spirit and scope of the present invention.

What is claimed is:

1. A method for implementing a thermodynamic cycle comprising the steps of:

expanding a gaseous working stream to transform its energy into usable form;

removing from the expanded gaseous working stream a withdrawal stream;

combining the withdrawal stream with a lean stream, having a higher content of a higher-boiling component than is contained in the withdrawal stream, to form a composite stream;

condensing the composite stream to provide heat;

separating the composite stream to form a liquid stream, said liquid stream forming a portion of said lean stream that is combined with the withdrawal stream, and a vapor stream;

forming an oncoming liquid working stream that evaporates at a temperature lower than the temperature at which said composite stream condenses; and evaporating said oncoming liquid working stream, using said heat produced by condensing said composite stream, to form said gaseous working stream.

2. The method of claim 1 further including removing a spent stream from said gaseous working stream and expanding the spent stream to transform its energy into usable form and then combining the spent stream with the liquid working stream prior to the liquid working stream being evaporated with heat transferred from the composite stream.

3. The method of claim 2 wherein the composite stream is expanded to a reduced pressure prior to being separated.

4. The method of claim 2 wherein the gaseous working stream, prior to being expanded, exchanges heat with the withdrawal stream and exchanges heat with the spent stream.

5. The method of claim 3 wherein the composite stream, prior to being expanded, exchanges heat with the lean stream and the liquid working stream.

6. The method of claim 5 wherein the composite stream, after being expanded, exchanges heat with a portion of the composite stream, that has not yet been expanded, and exchanges heat with the spent stream prior to the separation of the composite stream.

7. The method of claim 2 wherein the spent stream, prior to combining with the liquid working stream, exchanges heat with a portion of the gaseous working stream, and exchanges heat with a portion of the liquid working stream.

8. The method of claim 2 wherein the lean stream is pumped to a higher pressure than the pressure of the liquid stream formed from the separation of the composite stream and wherein the lean stream, after being pumped to a higher pressure, exchanges heat with the composite stream prior to combining with the withdrawal stream to form the composite stream; and wherein the liquid working stream is pumped to a higher pressure than the pressure of the liquid working stream when first formed, and wherein this high pressure liquid working stream exchanges heat with the composite stream and the spent stream until the heat transferred from the composite and spent streams to the liquid working stream evaporates the liquid working stream to form the gaseous working stream.

9. A method for implementing a thermodynamic cycle comprising the steps of:

superheating a gaseous working stream;

expanding the superheated gaseous working stream to transform its energy into usable form;

dividing the expanded gaseous working stream into a withdrawal stream and a spent stream;

reheating the spent stream and expanding the reheated spent stream;

cooling the withdrawal stream and the spent stream, after the expansion of the spent stream, the cooling of the withdrawal stream and the spent stream transferring heat used to superheat the gaseous working stream;

combining the withdrawal stream with a lean stream, having a higher content of a high-boiling component than the withdrawal stream, to form a composite stream that condenses over a temperature range that is higher than the temperature range required to evaporate an oncoming liquid working stream;

condensing the composite stream to provide heat to evaporate the oncoming liquid working stream, the evaporation of the liquid working stream transforming the liquid working stream into the gaseous working stream, and to provide heat to the lean stream;

cooling and condensing the composite stream to preheat the liquid working stream;

expanding the composite stream to reduce the pressure of the composite stream;

partially evaporating a first portion of the expanded composite stream with heat transferred from a counterstream of the same composite stream, that has not yet been expanded, and with heat transferred from said spent stream;

separating the partially evaporated composite stream to form a liquid stream, that produces the lean stream, and a vapor stream;

combining the vapor stream with a second portion of the expanded composite stream to form a pre-condensed working stream, and condensing that pre-condensed working stream to produce the liquid working stream;

pumping the lean stream to a higher pressure than the pressure of the liquid stream produced from the separation of the partially evaporated composite stream;

heating the high pressure lean stream with a counterstream of the composite stream formed by combining the lean stream with the withdrawal stream;

pumping the liquid working stream, formed from the condensation of said pre-condensed working stream, to a higher pressure, forming a high pressure liquid working stream;

preheating the high pressure liquid working stream with heat transferred from counterstreams of the composite stream and the spent stream; and evaporating the preheated high pressure liquid working stream with heat transferred from the composite stream, producing the gaseous working stream.

10. The method of claim 9 further including dividing said withdrawal stream into a first withdrawal stream and a second withdrawal stream, combining said first withdrawal stream with said lean stream to form a first composite stream for providing heat to evaporate said oncoming liquid working stream, and combining said first composite stream with said second withdrawal stream, after said first composite stream has provided heat to evaporate said oncoming liquid working stream, to form said composite stream that is used to preheat said liquid working stream.

11. The method of claim 9 wherein heat from the spent stream is used to evaporate a portion of the liquid working stream, after heat from the spent stream has been used to superheat the gaseous working stream.

12. A method for implementing a thermodynamic cycle comprising the steps of:

superheating a gaseous working stream;

expanding the superheated gaseous working stream to transform its energy into usable form;

dividing the expanded gaseous working stream into a withdrawal stream and a spent stream;

reheating the spent stream and expanding the reheated spent stream;

cooling the withdrawal stream and the spent stream, after the expansion of the spent stream, the cooling of the withdrawal stream and the spent stream transferring heat used to superheat the gaseous working stream;

combining the withdrawal stream with a lean stream, having a higher content of a high-boiling component than the withdrawal stream, to form a composite stream that condenses over a temperature range that is higher than the temperature range required to evaporate an oncoming liquid working stream;

condensing the composite stream to provide heat to evaporate the oncoming liquid working stream, the evaporation of the liquid working stream transforming the liquid working stream into said gaseous working stream;

cooling and condensing the composite stream to heat the lean stream and to preheat the liquid working stream;

preheating and partially evaporating the liquid working stream with heat from the spent stream, after heat from the spent stream has been used to superheat the gaseous working stream;

expanding the composite stream to reduce the pressure of the composite stream;

partially evaporating a first portion of the expanded composite stream with heat transferred from a counterstream of the same composite stream, that has not yet been expanded, and with heat transferred from said spent stream;

separating the partially evaporated composite stream in a separator to form a first liquid stream, that produces a portion of the lean stream, and a first vapor stream;

combining the first vapor stream with a second portion of the expanded composite stream in a scrubber, second liquid and second vapor streams flowing from said scrubber;

combining said first liquid stream flowing from said separator with said second liquid stream flowing from said scrubber to form said lean stream;

pumping the lean stream to a higher pressure than the pressure of the first liquid stream that is produced from the separation of the partially evaporated composite stream;

combining the second vapor stream flowing from said scrubber with a third portion of the composite stream, after the composite stream has been expanded, to form a pre-condensed stream, and condensing the pre-condensed stream to produce the liquid working stream;

heating the lean stream, after pumped to a higher pressure, with heat from a counterstream of the composite stream that is formed by combining the lean stream with the withdrawal stream;

pumping the liquid working stream, formed by the condensation of the pre-condensed working stream, to a higher pressure;

preheating the liquid working stream, after pumped to a higher pressure, with heat transferred from counterstreams of the composite and spent streams; and evaporating the preheated liquid working stream with heat transferred from the composite and spent streams, producing said gaseous working stream.

13. Apparatus for implementing a thermodynamic cycle comprising:

means for expanding a gaseous working stream to transform its energy into usable form;

means for removing from said expanded gaseous working stream a withdrawal stream;

a first stream mixer for combining the withdrawal stream with a lean stream, having a higher content of a high-boiling component than is contained in the withdrawal stream, to form a composite stream that condenses over a temperature range that is higher than the temperature range required to evaporate an oncoming liquid working stream;

a heat exchanger for condensing the composite stream to provide heat to evaporate the oncoming liquid working stream to form the gaseous working stream;

a gravity separator for separating the composite stream to form a liquid stream, a portion of which forms the lean stream, and a vapor stream; and a condenser for forming the liquid working stream that is evaporated by the composite stream in the heat exchanger.

14. The apparatus of claim 13 further including means for expanding a spent stream that is removed from said gaseous working stream to transform its energy into usable form.

15. The apparatus of claim 14 further including means for expanding the composite stream to a reduced pressure prior to separating the composite stream.

16. The apparatus of claim 14 further comprising a second heat exchanger that enables the gaseous working stream, prior to expansion, to exchange heat with the withdrawal stream and a third heat exchanger that enables the gaseous working stream to exchange heat with the spent stream.

17. The apparatus of claim 15 further comprising a second heat exchanger that enables the composite stream, prior to expansion, to exchange heat with the lean stream and to exchange heat with the liquid working stream to preheat the liquid working stream.

18. The apparatus of claim 17 further comprising a third heat exchanger that enables a first portion of the composite stream, after being expanded, to exchange heat with the composite stream prior to its being expanded and a fourth heat exchanger for allowing heat to be transferred to this portion of the composite stream from the spent stream prior to this portion of the composite stream being separated.

19. The apparatus of claim 18 further comprising a fifth heat exchanger that enables the spent stream to exchange heat with a portion of the gaseous working stream and sixth and seventh heat exchangers allowing the spent stream to exchange heat with a portion of the liquid working stream to preheat and evaporate the liquid working stream.

20. The apparatus of claim 19 further comprising a first pump for pumping the lean stream to a higher pressure than the pressure of the liquid stream that is formed from the separation of the composite stream, the second heat exchanger enabling the lean stream, after being pumped to a higher pressure, to exchange heat with the composite stream prior to combining with the withdrawal stream to form the composite stream, a second pump for pumping the liquid working stream to a higher pressure than the pressure of the liquid working stream flowing from said condenser, the second heat exchanger enabling this liquid working stream, after pumped to a higher pressure, to exchange heat with the composite stream to preheat the liquid working stream.

21. Apparatus for implementing a thermodynamic cycle comprising:

a heater for superheating a gaseous working stream;

means for expanding the superheated gaseous working stream to transform its energy into usable form;

a first stream separator for dividing the expanded gaseous working stream into a withdrawal stream and a spent stream;

a reheater for reheating the spent stream and means for expanding the reheated spent stream after reheating;

first and second heat exchangers for cooling the withdrawal stream and the spent stream, after the expansion of the spent stream, the cooling of the withdrawal stream and the spent stream transferring heat used to superheat the gaseous working stream;

a first stream mixer for combining the withdrawal stream with a lean stream, having a higher content of a high-boiling component than the withdrawal stream, to form a composite stream that condenses over a temperature range that is higher than the temperature range required to evaporate an oncoming liquid working stream;

a third heat exchanger for condensing the composite stream to provide heat to partially evaporate the oncoming liquid working stream, transforming the liquid working stream into a gaseous working stream;

means for expanding the composite stream to reduce the pressure of the composite stream;

a fourth heat exchanger for partially evaporating a first portion of the expanded composite stream with the heat transferred from a counterstream of the same composite stream, that has not yet been expanded, and a fifth heat exchanger for partially evaporating this portion of the expanded composite stream with heat transferred from said spent stream;

a gravity separator for separating the partially evaporated first portion of the composite stream to form a first liquid stream, that forms a portion of the lean stream, and a first vapor stream;

a scrubber for combining the first vapor stream with a second portion of said expanded composite stream, and for enabling second vapor and second liquid streams to flow from said scrubber;

a second stream mixer for combining said first liquid stream and said second liquid stream to form said lean stream;

a first pump for pumping the lean stream to a higher pressure than the pressure of the first liquid stream that is produced from the separation of the partially evaporated first portion of the composite stream;

a third stream mixer for combining a third portion of the expanded composite stream with the second vapor stream, forming a pre-condensed working stream;

a condenser for condensing the pre-condensed working stream to produce the liquid working stream; and a second pump for pumping the liquid working stream, after it flows from the condenser, to a pressure that is higher than the pressure of the liquid working stream after it flows from the condenser, said high pressure liquid working stream evaporated in said third heat exchanger to produce said gaseous working stream.

22. The method of claim 21 further including a second stream separator for dividing said withdrawal stream into a first withdrawal stream and a second withdrawal stream, said first withdrawal stream combining with said lean stream to form a first composite stream for transferring heat to evaporate said oncoming liquid working stream, and a fourth stream mixer for combining said second withdrawal stream with said first composite stream, after said first composite stream transferred heat to evaporate said oncoming liquid working stream, to form said composite stream used to preheat said liquid working stream.

23. The apparatus of claim 21 further comprising a sixth heat exchanger for enabling heat from the composite stream to preheat the lean and liquid working streams, and seventh and eighth heat exchangers for enabling heat from the spent stream to preheat and evaporate a portion of the liquid working stream to form part of the gaseous working stream.

24. Apparatus for implementing a thermodynamic cycle comprising:

a heater for superheating a gaseous working stream;

means for expanding the superheated gaseous working stream to transform its energy into usable form;

a first stream separator for dividing the expanded gaseous working stream into a withdrawal stream and a spent stream;

a reheater for reheating the spent stream and means for expanding the reheated spent stream;

first and second heat exchangers for cooling the withdrawal stream and the spent stream, after the expansion of the spent stream, the cooling of the withdrawal stream and the spent stream transferring heat used to superheat the gaseous working stream;

a first stream mixer for combining the withdrawal stream with a lean stream, having a higher content of a high-boiling component than the withdrawal stream, to form a composite stream that condenses over a temperature range that is higher than the temperature range required to evaporate an oncoming liquid working stream;

a third heat exchanger for condensing the composite stream to provide heat to partially evaporate the oncoming liquid working stream, transforming the liquid working stream into part of a gaseous working stream;

a fourth heat exchanger for cooling and condensing the composite stream to preheat the lean and liquid working stream;

means for expanding the composite stream to reduce the pressure of the composite stream;

a fifth heat exchanger for partially evaporating a first portion of the expanded composite stream with heat transferred from a counterstream of the same composite stream, that has not yet been expanded, and a sixth heat exchanger enabling heat transferred from said spent stream to partially evaporate this first portion of the expanded composite stream;

a gravity separator for separating the partially evaporated first portion of the composite stream to form a first liquid stream, that forms a portion of the lean stream, and a first vapor stream;

a scrubber for combining the first vapor stream with a second portion of said expanded composite stream, and for enabling second vapor and second liquid streams to flow from said scrubber;

a second stream mixer for combining said first liquid stream and said second liquid stream to form said lean stream;

a first pump for pumping the lean stream to a higher pressure than the pressure of the first liquid stream that is produced from the separation of the partially evaporated first portion of the composite stream;

a seventh heat exchanger for transferring heat from the spent stream, after it has transferred heat to the gaseous working stream, to the liquid working stream to evaporate the liquid working stream to form part of the gaseous working stream and an eighth heat exchanger enabling heat from the spent stream to preheat the liquid working stream;

a third stream mixer for mixing the second vapor stream with a third portion of the expanded composite stream to form a pre-condensed working stream;

a condenser for condensing the pre-condensed working stream to produce the liquid working stream; and a second pump for pumping the liquid working stream, after it flows from the condenser, to a higher pressure, before the liquid working stream is preheated in the fourth and eighth heat exchangers.

25. The apparatus of claim 22 wherein the means for expanding the superheated gaseous working stream is a turbine, the means for expanding the reheated spent stream is a turbine, and the means for expanding the composite stream is a hydraulic turbine.

* * * * *